US008191297B2

(12) United States Patent
Gwillim, Jr.

(10) Patent No.: US 8,191,297 B2
(45) Date of Patent: Jun. 5, 2012

(54) DEVICE FOR INDICATING LOW AMMUNITION IN A FIREARM MAGAZINE

(76) Inventor: Reese C. Gwillim, Jr., Boulder Creek, CA (US)

( * ) Notice: Subject to any disclaimer, the term of this patent is extended or adjusted under 35 U.S.C. 154(b) by 443 days.

(21) Appl. No.: 12/535,454

(22) Filed: Aug. 4, 2009

(65) Prior Publication Data

US 2011/0030257 A1 Feb. 10, 2011

(51) Int. Cl.
*F41A 9/62* (2006.01)

(52) U.S. Cl. ..... 42/1.02; 42/50; 42/49.1; 89/33.1

(58) Field of Classification Search ..... 42/1.02, 42/50, 49.01; 89/33.1
See application file for complete search history.

(56) References Cited

U.S. PATENT DOCUMENTS 5,052,138 A 10/1991 Crain
5,519,953 A 5/1996 Villani
5,592,769 A 1/1997 Villani
5,642,581 A 7/1997 Herold et al.
5,735,070 A 4/1998 Vasquez et al.
5,799,432 A 9/1998 Wright, Sr. et al.
5,826,360 A 10/1998 Herold et al.
6,094,850 A * 8/2000 Villani ..... 42/1.02
7,032,342 B2 4/2006 Pikielny
7,536,816 B2 * 5/2009 Weinberger ..... 42/1.02
2008/0276517 A1 11/2008 Delgado Acarreta
2009/0094875 A1 4/2009 Kim

* cited by examiner

*Primary Examiner* — J. Woodrow Eldred
(74) *Attorney, Agent, or Firm* — Schneck & Schneck; David Schneck

(57) ABSTRACT

A device for indicating a limited amount of remaining ammunition in a firearm magazine is disclosed. A switch is mounted within the magazine, to a plate at a bottom end of the magazine. The plate may be a magazine insert, a floor plate, a base plate or a base pad. The switch cooperates with or responds to a segment or portion of a magazine spring. An indicating terminal is coupled with the switch. A change in state of the switch activates and deactivates the indicating terminal. The indicating terminal may be electrically connected to an indicating device. The indicating device may be an LED, an incandescent bulb or a light. The "on" and "off" states of the switch correspond to differing positions of the segment of the spring relative to the switch or to the plate and attendant differing amounts of ammunition in the magazine.

20 Claims, 6 Drawing Sheets

DEVICE FOR INDICATING LOW AMMUNITION IN A FIREARM MAGAZINE

TECHNICAL FIELD

The present invention relates generally to firearms and, more specifically, to magazines for firearms.

BACKGROUND

Discharging successive rounds from a firearm consumes ammunition. It would be advantageous to indicate a low ammunition condition to the user of a firearm. A low ammunition indication is potentially life saving to a law enforcement officer, soldier or responsible citizen engaged in a needed use of the firearm, for example during a firelight against hostile forces.

Semiautomatic firearms often have a feature to lock the slide open upon discharge of the final round from a magazine, providing an indication of zero ammunition remaining. An indication of low ammunition prior to the condition of zero ammunition allows the user of a firearm to conserve remaining rounds and plan for reloading. Counting and attempting to remember the number of shots fired is well-known to be a difficult and unreliable method to apply in an intense situation. To remedy this difficulty, various devices are known for indicating low ammunition in a firearm.

U.S. Pat. No. 5,642,581 MAGAZINE FOR A FIREARM INCLUDING A SELF-CONTAINED AMMUNITION COUNTING AND DISPLAY SYSTEM, to Herold et al. discloses a magazine for a firearm with electrical contacts corresponding in number to the number of rounds of ammunition capable of being loaded into the upper portion of the magazine. The magazine follower has a sliding contact, which connects to a particular electrical contact in the magazine corresponding to a number of rounds remaining in the upper portion of the magazine. A seven segment LED display shows a digit indicating the numerical count of rounds of ammunition within the magazine. Alternatively, LEDs indicate a number of rounds. The LED display or LEDs are positioned in the lower part of the magazine, viewable by the user of the firearm.

U.S. Pat. No. 5,052,138 AMMUNITION SUPPLY INDICATING SYSTEM, to Crain discloses a magazine for a firearm with electrical contact strips in pairs along opposing side walls of the magazine. The magazine follower makes contact with the contact strips, providing a count of the number of cartridges or rounds present in the magazine. A display housing on the body of the pistol has a numerical display visible to the user. Wires, contacts and electronic circuitry convey and combine various signals to operate the display.

U.S. Pat. No. 5,592,769 AUTOMATIC CARTRIDGE MONITORING AND INDICATOR SYSTEM FOR A FIREARM, to Villani discloses various magazine follower mechanisms contacting various switch mechanisms in the grip of the firearm, in multiple embodiments of a cartridge monitoring system. The follower mechanisms are installed on the follower of a firearm magazine or in an intermediate device between a first spring and a second spring in the magazine. An indicator device has three LEDs of different colors positioned near the top of the grip, and each LED energizes to indicate 3, 2 or 1 cartridge left. Alternatively, a mechanical indicator moves as cartridges are expended.

U.S. Pat. No. 5,735,070 ILLUMINATED GUNSIGHT AND LOW AMMUNITION WARNING ASSEMBLY FOR FIREARMS, to Vasquez et al. discloses an illuminated gunsight and a low ammunition warning assembly, which uses a vibratory system to indicate a low ammunition condition. In one embodiment, electrical contacts are associated with a prong mounted to the internal structure of a gun. The contacts and the prong detect the presence or absence of a round at the top of the magazine. When the last round exits the magazine, the vibratory system is activated. In another embodiment, electrical contacts detect the movement of the rack structure of the gun. An electronic circuit device programmed with the total number of rounds can subtract for each motion of the rack structure and determine when the rounds of ammunition remaining in the magazine have reached a predetermined amount, and then activate the vibrating motor in the gun handle.

Existing devices often have modifications to the firearm as well as to the magazine, and require electrical connection between the firearm and the magazine. It is an object of the present invention to provide a device for indicating low ammunition in a firearm.

SUMMARY

These and other objects have been achieved by a device for indicating when a firearm magazine has a limited amount of remaining ammunition, as described herein. A switch is mounted to a plate at a bottom end of a firearm magazine. The plate may be an insert, a floor plate, a base plate or a base pad. The switch is within the magazine. The switch cooperates with or is responsive to a segment or a portion of a magazine spring. The "on" and "off" states of the switch correspond to differing positions of the segment of the spring relative to the switch and attendant differing amounts of ammunition in the magazine.

An indicating terminal is coupled with the switch. A change in a state of the switch activates and deactivates the indicating terminal. An indicating device may be electrically connected to the indicating terminal. The indicating device may be an LED, an incandescent lamp or other light source. The light source may illuminate in a rearward direction of the magazine and be visible to a user holding a firearm with the magazine inserted therein.

The switch may be a switch including a lever, a button or other actuator at least partially engaging the spring. In another embodiment, the switch may be a reed switch responding to a magnet attached to the portion of the spring.

The position of the portion of the spring varies in response to a varied remaining amount of rounds in the magazine, due to compression and extension of the spring. The switch directs activation of the indicating terminal or indicating device in response to a range of positions of the portion of the spring corresponding to the remaining amount of rounds being less than or equal to a predetermined low ammunition count. The switch may direct available power from a battery contact to illuminate a light for the spacing from the portion of the spring to the plate being greater than or equal to a specified trip point distance. Thereby, the device detects and indicates a low ammunition condition.

Advantages of the low ammunition indicator device include light weight, low component parts count, usability with a variety of switches and provision of potentially life saving information to the user of a firearm. The device does not interfere with the standard operation of a firearm magazine, and may be provided as a retrofit kit or a fully assembled magazine having the device therewith. Such a magazine may be inserted into a firearm without requiring any modification of the firearm.

DETAILED DESCRIPTION

Figure 1:
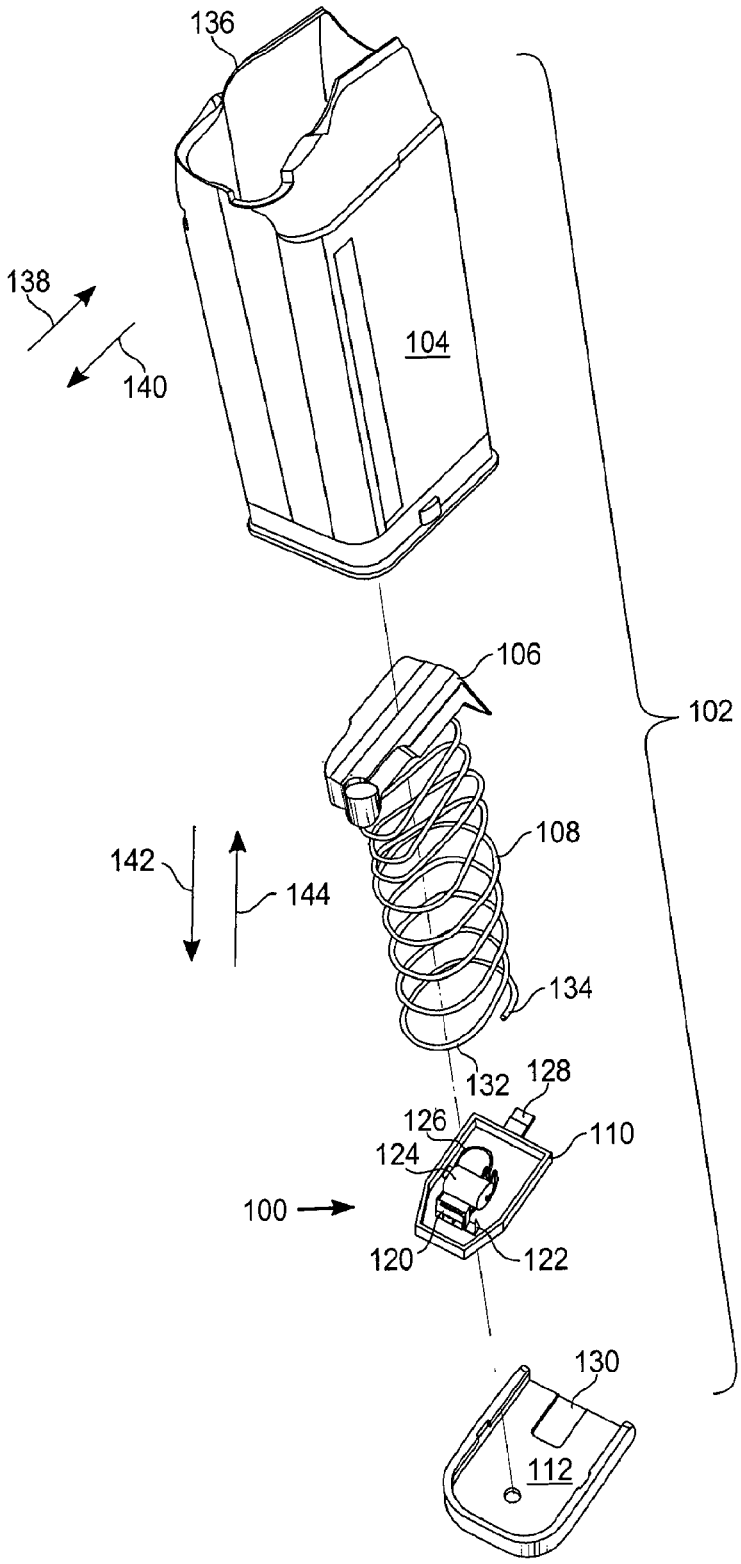
FIG. 1 is an exploded view of a firearm magazine having a device for indicating when the magazine has a limited amount of remaining ammunition, in accordance with an embodiment of the invention.

In FIG. 1, a firearm magazine 102 including a device 100 for indicating when the firearm magazine has a limited amount of remaining ammunition is shown in an exploded view, in accordance with an embodiment of the invention. A standard magazine, having a magazine case 104, follower 106, magazine spring 108, insert 110 and floor plate 112, can be assembled and loaded with a specified number of rounds or cartridges (not shown) up to the capacity of the magazine. Assembling the magazine 102 with the low ammunition indicator device 100 provides the user of the firearm an indication of whether the remaining number or amount of rounds in the magazine is low.

A switch 120 in the low ammunition indicator device 100 interacts or cooperates with a segment or a portion 132 of the magazine spring 108, providing electrical power from a battery 124 to an LED 128 or other indicating device via wires 126. Illumination of the LED 128 indicates a low ammunition condition. The "on" and "off" states of the switch correspond to differing positions of the segment of the spring relative to the switch and attendant differing amounts of ammunition in the magazine. Operation of the magazine is not impeded by the installation, presence or action of the low ammunition indicator device 100, and full capacity of the magazine is retained.

Per standard operating procedure of a firearm magazine, rounds are inserted sequentially in an insertion direction 138 at the top of the magazine case 104, the uppermost round being retained by the magazine lip 136 and the rounds stacking within the magazine case 104. As the rounds are loaded into the magazine, the follower 106 moves in a downward direction 142, compressing the magazine spring 108. As the number of rounds in the magazine exceeds a predetermined low ammunition amount, the magazine spring 108 becomes sufficiently compressed that the portion 132 of the magazine spring 108 changes the state of the switch 120, turning off or otherwise deactivating the LED 128 or other indicating device. Thus, sufficient remaining ammunition in the magazine is represented by the low ammunition indicator device 100 having the LED 128 turned off.

Rounds are sequentially removed in a removal direction 140 from the magazine, either manually for demonstration or verification purposes, or by inserting the loaded magazine into the firearm (not shown) using applicable safety rules, racking the slide to insert a round into the firing chamber and discharging rounds by firing. Although herein described for a semiautomatic firearm, an embodiment may be made for other types of firearms such as a bolt action or fully automatic firearm, although not a revolver. Although herein described for a removable magazine, an embodiment may be made for a firearm having a fixed magazine.

As the rounds are removed from the magazine, the follower 106 moves in an upward direction 144, uncompressing or extending the magazine spring 108. As the number of rounds becomes or drops below a predetermined low ammunition amount, the magazine spring 108 becomes sufficiently uncompressed or extended that the portion 132 of the magazine spring 108 changes the state of the switch 120, turning on or otherwise activating the LED 128 or other indicating device. Thus, insufficient remaining ammunition, a low ammunition condition, is represented by the low ammunition indicator device 100 having the LED 128 turned on.

In the embodiment shown in FIG. 1, the components for the low ammunition indicator device 100 are mounted on a plate, which may be the insert 110 as shown or may be the floor plate 112, a base plate or a base pad. When the components are mounted on the insert 110, the LED 128 may be mounted to the bottom or backside of the insert 110, and a clearance notch 130 carved out of the floor plate 112. Other mountings may be devised by a person skilled in the art.

Figure 2:
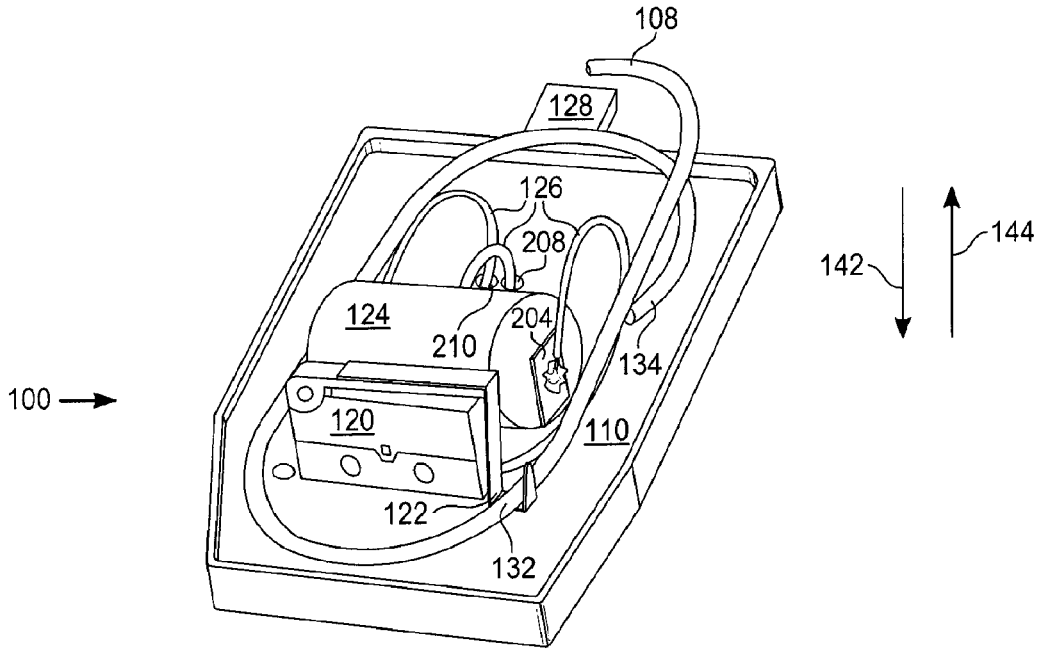
FIG. 2 is a perspective view of a first embodiment of the low ammunition indicator device from FIG. 1, having a lever switch.

In FIG. 2, an enlarged perspective view of a first embodiment of the low ammunition indicator device 100 of FIG. 1 is shown. Slightly more than one coil, loop or turn of the magazine spring 108 is shown, cut away from the remainder of the magazine spring. A bottom end 134 of the magazine spring 108 rests upon the insert 110. The switch 120 and the battery 124 nestle within the lower coils of the spring 108 so that the components do not interfere with the operation of the spring 108 or any other part of the magazine. Wires 126 connect the components as will be discussed with regard to circuit diagrams in FIGS. 9A-9D. When LED 128 is mounted on the back side of the insert 110, wires 126 may be routed through apertures 208 and 210 through the insert 110. A person skilled in the art may devise suitable component mountings and wire routings.

Switch 120 responds to and interacts with a portion 132 of the magazine spring 108. The position of the portion 132 of the magazine spring 108 varies in response to a varied remaining amount of rounds in the magazine, due to compression and extension of the spring. In the first embodiment, of FIG. 2, the portion 132 of the magazine spring 108 presses on or lifts up from a lever 122 of the switch 120, depending upon the amount of compression of the magazine spring and attendant amount of ammunition in the magazine.

The LED 128 is responsive to the switch 120. The switch directs available power from the battery contact 204 to illuminate the LED 128 or other light source, when the spacing from the portion 132 of the magazine spring 108 to the insert 110 or other mounting plate is greater than or equal to a specified trip point distance. Thereby, the low ammunition indicator device 100 detects and indicates a low ammunition condition.

Sufficient remaining ammunition and a suitably compressed magazine spring 108 cause the lever 122 of the switch 120 to be pressed in a downward direction 142, turning off the LED 128. The switch 120 directs deactivation of the LED 128 or other indicating device in response to a range of positions of the portion 132 of the magazine spring 108 corresponding to the remaining amount of rounds being greater than a predetermined low ammunition count, thereby detecting and indicating sufficient ammunition.

A low ammunition condition and a suitably uncompressed magazine spring 108 cause the lever 122 of the switch 120 to lift in an upward direction 144, turning on the LED 128. The switch 120 directs activation of the LED 128 or other indicating device in response to a range of positions of the portion 132 of the magazine spring 108 corresponding to the remaining amount of rounds being less than or equal to a predetermined low ammunition count, thereby detecting and indicating low or insufficient ammunition.

In the first embodiment, the switch 120 is a lever switch, of a type normally closed when the lever is not pressed. Opening the switch 120, by pressing on the lever 122, cuts off power delivery to the indicating device. Closing the switch 120, by allowing the lever 122 to lift up, completes the circuit and delivers power to the indicating device. The lever 122 may be part of the switch 120 as a lever switch, or the lever 122 may be separately mounted and interact with the switch 120. As the portion 132 of the magazine spring 108 moves in an upward direction 144 and the state of the switch 120 changes, the portion 132 of the magazine spring 108 may remain in contact with the lever 122 or lift up from the lever 122.

In addition to other mountings and wire routings, various types of switches, switch polarities and operating states may be used in embodiments. A person skilled in the art may use normally open switches, normally closed switches, sensors acting as switches, other components acting between power sources, switches and indicating devices and other types of indicating devices in embodiments. Various types of actuators may be associated with switches as part of a switch itself or as separately mounted and interacting with a switch. For example, switches such as a lever switch, a button switch, a snap switch, a contact switch, an actuator switch, a membrane switch, a sealed switch, a reed switch or a magnetic proximity sensor may be used to respond to a portion of the magazine spring. As a further example, active electronics such as an inverter may be used in swapping a normally open switch for a normally closed switch in a circuit.

An LED, an incandescent bulb or other lamp or light may be used as an indicating device, as may an audible device such as a beeper or speaker. Multiple LEDs or multiple miniature incandescent bulbs may be used, or any combination thereof. A vibrating device may be used as an indicating device. Components may be mounted on a plate such as an insert, a floor plate, a base plate or a base pad. An indicating terminal, coupled with the switch, may be electrically connected to an indicating device. The indicating terminal may be connected to other electronic circuitry in addition to or in lieu of an LED or incandescent bulb. One or more cells or batteries or other power sources may be used. Cells or batteries may be replaceable in a battery holder, or may be rechargeable in a battery holder or permanently mounted. A contact may draw power from a battery holder and thereby from a battery inserted into the battery holder, or may be directly attached to a battery, such as by soldering to a rechargeable cell.

Figure 3:
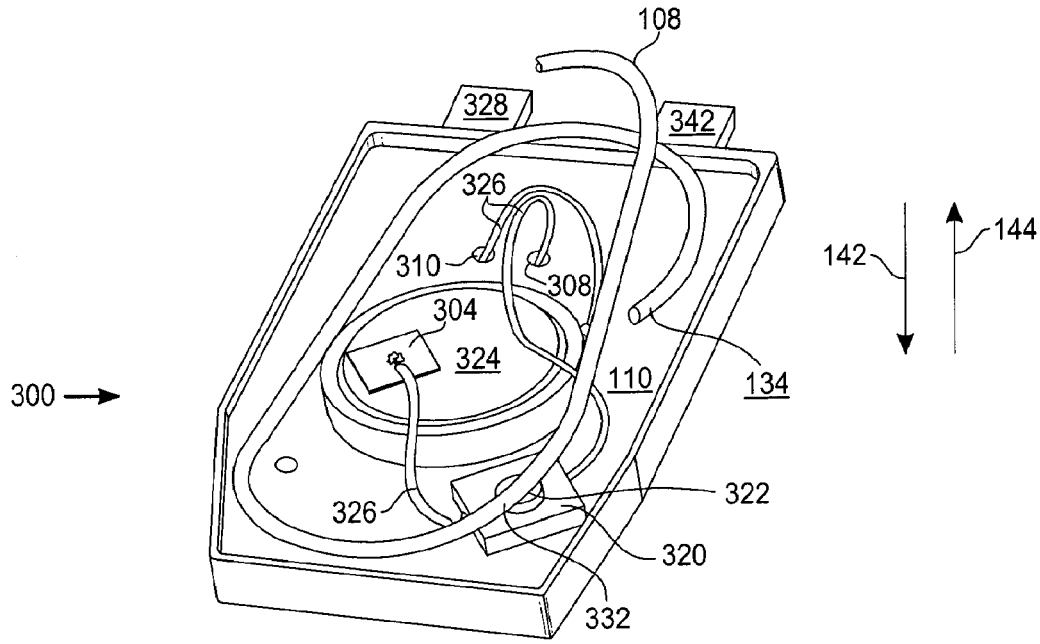
FIG. 3 is a perspective view of a second embodiment of the low ammunition indicator device from FIG. 1, having a button switch.

In FIG. 3, a perspective view of a second embodiment of the low ammunition indicator device 300 is shown. Slightly more than one coil of the magazine spring 108 is shown. A bottom end 134 of the magazine spring 108 rests upon the insert 110. The switch 320 and the battery 324 are attached to the insert 110. LEDs 328 and 342 are mounted to the insert 110. Wires 326 connect to an electrical contact 304 and thereby the battery 324, as well as to the remaining components. Wires 326 are routed through apertures 308 and 310 to connect to the LEDs.

Switch 320 responds to and interacts with a portion 332 of the magazine spring 108. In the second embodiment, of FIG. 3, the portion 332 of the magazine spring 108 presses on or lifts up from the button 322 of the switch 320, depending upon the amount of compression of the magazine spring and attendant amount of ammunition in the magazine. Sufficient remaining ammunition and a suitably compressed spring 308 causes the button 322 of the switch 320 to be pressed in a downward direction 142, turning off the LEDs 328 and 342. A low ammunition condition and a suitably uncompressed magazine spring 108 causes the button 322 of the switch 320 to lift in an upward direction 144, turning on the LEDs 328 and 342. In the second embodiment the switch 320 is a button switch, of a type normally closed when the button is not pressed. Opening the switch 320, by pressing on the button 322, cuts off power delivery to the indicating device. Closing the switch 320, by allowing the button 322 to lift up, completes the circuit and delivers power to the indicating device. The button 322 may be part of the switch as a button switch, or the button 322 may be separately mounted and interact with the switch 320.

Figure 4:
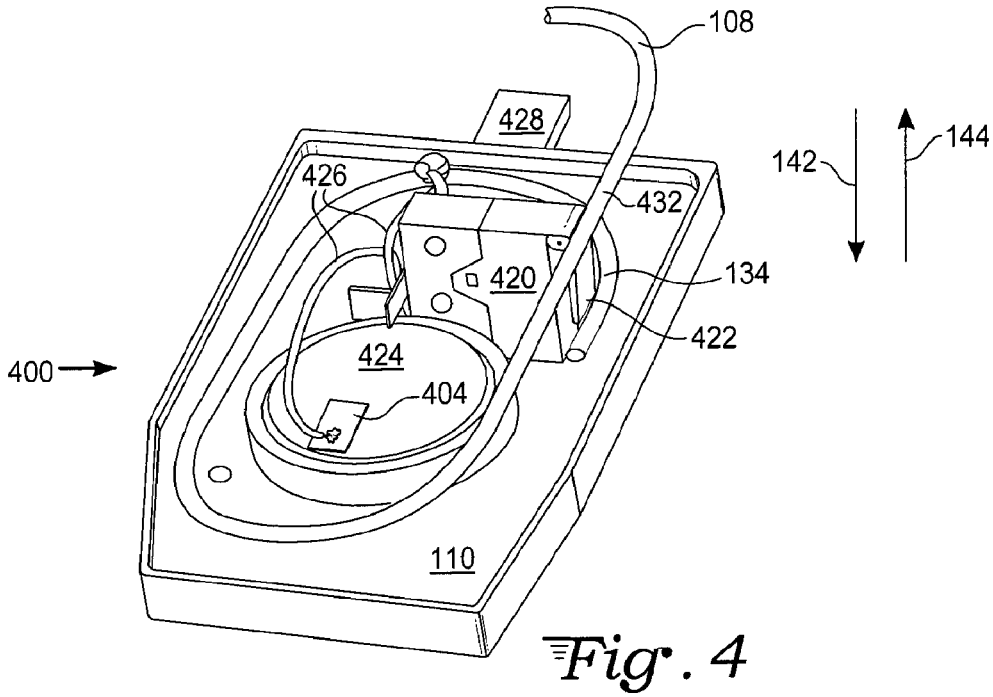
FIG. 4 is a perspective view of a third embodiment of the low ammunition indicator device from FIG. 1, having a side-mounted lever switch.

In FIG. 4, a perspective view of a third embodiment of the low ammunition indicator device 400 is shown. Slightly more than one coil of the magazine spring 108 is shown. A bottom end 134 of the magazine spring 108 rests upon the insert 110. The switch 420 and the battery 424 are attached to the insert 110. LED 428 is mounted to the insert 110. Wires 426 connect to an electrical contact 404 and thereby the battery 424, as well as to the remaining components. Wires 426 are routed through apertures 408 and 410 to connect to the LED 428.

Switch 420 responds to and interacts with a portion 432 of the magazine spring 108. In the third embodiment, of FIG. 4, the portion 432 of the magazine spring 108 presses on or lifts up from the lever 422 of the switch 420, depending upon the amount of compression of the magazine spring and attendant amount of ammunition in the magazine. Sufficient remaining ammunition and a suitably compressed spring 408 causes the lever 422 of the switch 420 to be pressed inward as the portion 432 of the magazine spring 108 moves in a downward direction 142, turning off the LED 428. A low ammunition condition and a suitably uncompressed magazine spring 108 causes the lever 422 of the switch 420 to lift outward as the portion 432 of the magazine spring 108 moves in an upward direction 144, turning on the LED 428. In the third embodiment the switch 420 is a side-mounted lever switch, of a type normally closed when the lever is not pressed. Opening the switch 420, by pressing on the lever 422, cuts off power delivery to the indicating device. Closing the switch 420, by allowing the lever 422 to lift up, completes the circuit and delivers power to the indicating device. The lever 422 may be part of the switch 422 as a button switch, or the lever 422 may be separately mounted and interact with the switch 420.

Figure 5:
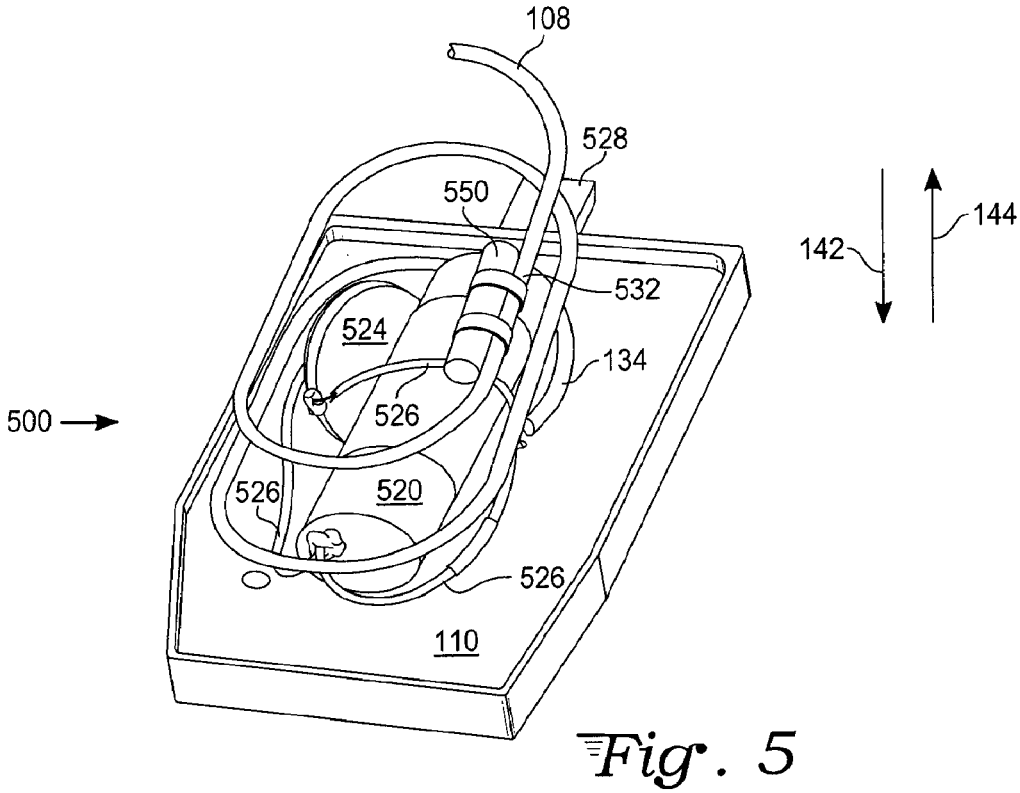
FIG. 5 is a perspective view of a fourth embodiment of the low ammunition indicator device from FIG. 1, having a reed switch.
Figure 6:
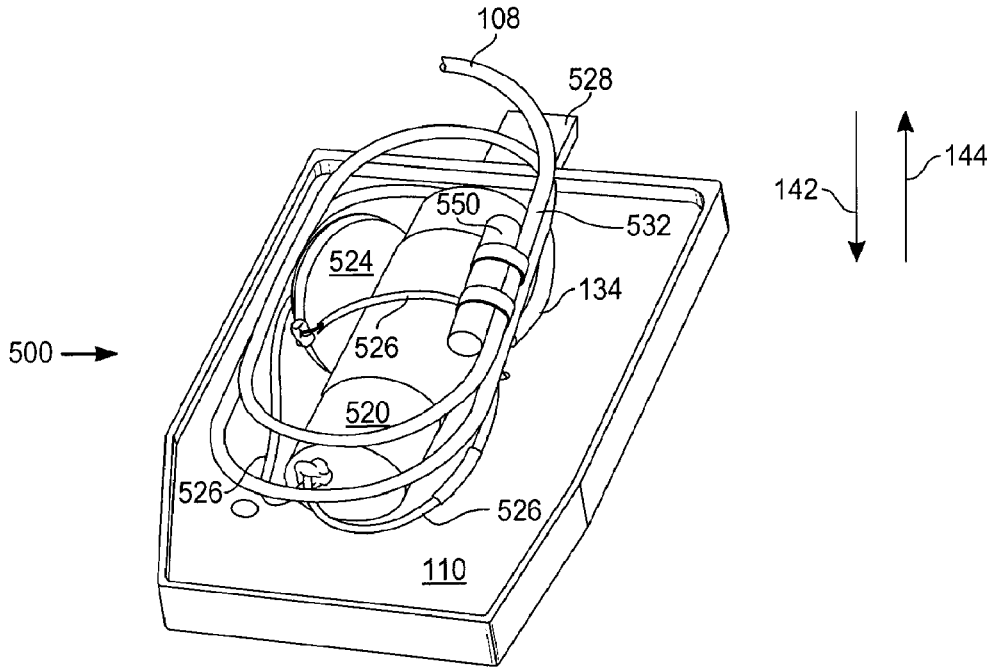
FIG. 6 is a perspective view of the fourth embodiment of the low ammunition indicator device of FIG. 5, with the magazine spring compressed.

In FIGS. 5 and 6, a perspective view of a fourth embodiment of the low ammunition indicator device 500 is shown. Slightly more than one coil of the magazine spring 108 is shown. A bottom end 134 of the magazine spring 108 rests upon the insert 110. The switch 520 and the battery 524 are attached to the insert 110. LED 528 is mounted to the insert 110. Wires 526 connect the components.

Switch 520 responds to and interacts with a portion 532 of the magazine spring 108. In the fourth embodiment, of FIG. 5, a magnet 550 is fastened to a portion 532 of the magazine spring 108. A person skilled in the art may devise a suitable fastener attaching the magnet to a wire of the spring or spanning a coil of the spring. The switch 520 is a reed switch, which opens or closes depending upon the proximity of a magnet. The switch 520, being a reed switch, is thus responsive to the magnet 550 attached to the segment or portion 532 of the magazine spring 108. The portion 532 of the magazine spring 108, along with the attached magnet 550, moves closer to or further from the switch 520, depending upon the amount of compression of the magazine spring and attendant amount of ammunition in the magazine. As shown in FIG. 6, sufficient remaining ammunition and a suitably compressed spring 508 causes the portion 532 of the magazine spring 108 and the attached magnet 550 to move in a downward direction 142 closer to the reed switch 520, turning off the LED 528. As shown in FIG. 5, a low ammunition condition and a suitably uncompressed magazine spring 108 causes the portion 532 of the magazine spring 108 and the attached magnet 550 to move in an upward direction 144 farther from the reed switch 520, turning on the LED 528. In the fourth embodiment the switch 520 is a reed switch of a type normally closed when a magnet is not nearby. Opening the switch 520, by having the magnet 550 nearby as in FIG. 6, cuts off power delivery to the indicating device. Closing the switch 520, by having the magnet 550 farther away from the reed switch 520 as in FIG. 5, completes the circuit and delivers power to the indicating device.

Figure 7:
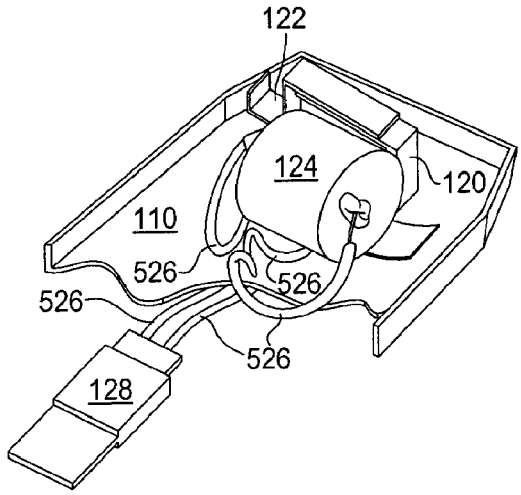
FIG. 7 is a cutaway perspective view of the first embodiment of the low ammunition indicator device of FIG. 2.

In FIG. 7, the first embodiment of the low ammunition indicator device is again shown, with a portion of the insert 110 cutaway. Relative positioning and mounting details for the LED 128, battery 124, switch 120, lever 122 and wire 526 routings can be seen clearly, although other positionings, mountings, and routings may be devised.

Figure 8:
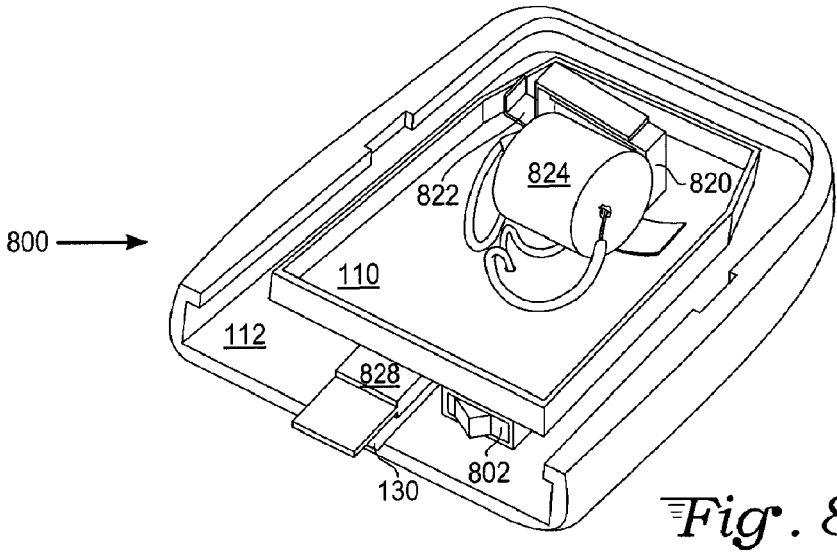
FIG. 8 is a fifth embodiment of the low ammunition indicator device from FIG. 1, having an on/off switch.

In FIG. 8, a fifth embodiment of the low ammunition indicator device 800 is shown, having similar components and mountings as the embodiments in FIGS. 1, 2 and 7, but with an added on/off switch 802. LED 828 is mounted on the back side of insert 110, and is turned on and off by the switch 820 using power provided by the battery 824. Base plate 112 has a notch 130 allowing clearance for the LED 828. The lever 822 from the switch 820 interacts with the magazine spring (not shown) in a manner previously described with the first embodiment. The on/off switch 802 is switched off for long-term storage of an empty or low magazine, so that the battery is not depleted due to powering the lamp. The on/off switch 802 is switched on for use of the low ammunition indicator device 800 in indicating the presence or absence of a low ammunition condition, or for long-term storage of a magazine that is fully loaded or loaded with sufficient ammunition so as not to activate the lamp.

In embodiments shown in FIGS. 1-8, the LED, incandescent bulb or other lamp is mounted so as to illuminate in a rearward direction of the magazine and be visible to the user holding the firearm into which the magazine has been inserted, and not visible or less readily visible to a perpetrator or other hostile person at whom the firearm is aimed. With such a mounting, the user of the firearm benefits from the information imparted by the indicating device, and the perpetrator or hostile does not. Other mountings may be devised. Mounting an indicating device as a light visible external to the magazine may also aid officers arriving at a crime scene in quickly assessing the situation.

A person skilled in the art may devise various circuits in embodiments of the low ammunition indicator device. Some lamps or other indicating devices may need a specific battery polarity or connection while other lamps or indicating devices may operate with any battery polarity. A switch may connect or disconnect power to or from an anode or cathode of an LED or from either terminal of an incandescent bulb. An LED or incandescent bulb may or may not need a current-limiting resistor. A current-limiting resistor may be placed in various locations in a circuit path. An on/off switch may be placed in various locations in a circuit path. Circuit variations are shown in FIGS. 9A-9D. An incandescent lamp may be substituted for an LED in an embodiment. Multiple LEDs may be used in series or parallel connections.

Figure 9A:
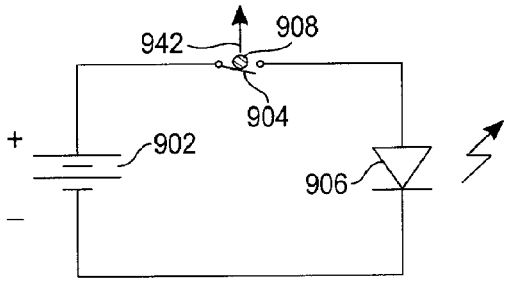
FIG. 9A is a circuit diagram of an embodiment of the low ammunition indicator device from FIG. 1.

In FIG. 9A, a battery 902, switch 904 and LED 906 are shown in series connection. The circuit of FIG. 9A is suitable for any of the first, second, third or fourth embodiments. A portion 908 of the magazine spring is shown in profile interacting to open or close the switch 904.

Figure 9B:
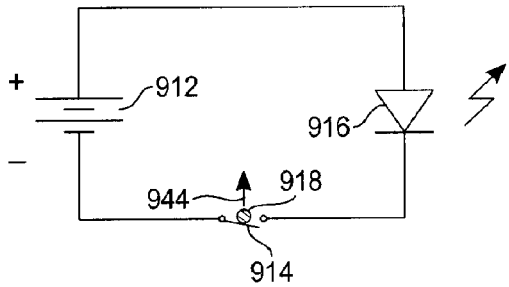
FIG. 9B is a circuit diagram of a further embodiment of the low ammunition indicator device from FIG. 9A, with the switch relocated.

In FIG. 9B, a battery 912, LED 916 and switch 914 are shown in series connection. The circuit of FIG. 9B is suitable for any of the first, second, third or fourth embodiments. A portion 918 of the magazine spring is shown in profile interacting to open or close the switch 914.

Figure 9C:
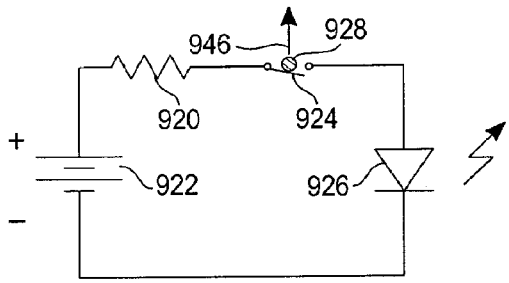
FIG. 9C is a circuit diagram of a further embodiment of the low ammunition indicator device from FIG. 9A, having a current-limiting resistor.

In FIG. 9C, a battery 922, a current-limiting resistor 920, a switch 924 and LED 926 are shown in series connection. The circuit of FIG. 9C is suitable for any of the first, second, third or fourth embodiments as modified by the addition of the series current-limiting resistor 920. A portion 928 of the magazine spring is shown in profile interacting to open or close the switch 924. The current-limiting resistor 920 may be located elsewhere in series connection with the components.

Figure 9D:
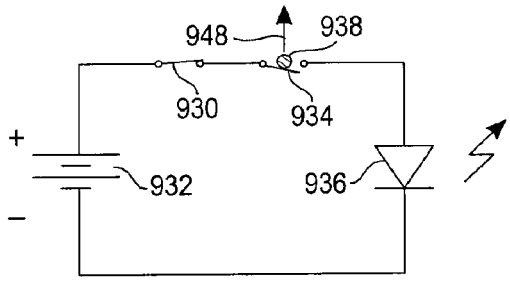
FIG. 9D is a circuit diagram of the fifth embodiment of the low ammunition indicator device from FIG. 8, having an on/off switch.

In FIG. 9D, a battery 932, an on/off switch 930, a switch 934 and an LED 936 are shown in series connection. The circuit of FIG. 9D is suitable for the fifth embodiment, or any of the first, second, third or fourth embodiments as modified by the addition of the on/off switch 930. A portion 938 of the magazine spring is shown in profile interacting to open or close the switch 934. The on/off switch 930 is shown closed, turning the circuit on. The on/off switch 930 is opened to turn the circuit off. The on/off switch 930 may be located elsewhere in series connection with the components, and serves to connect and disconnect electrical power to the remainder of the circuitry.

In FIGS. 9A-9D, switches 904, 914, 924 and 934, respectively, are shown schematically as having a contact lever opening downward and closing in an upward direction 942, 944, 946 and 948 respectively. A profile view of a portion 908, 918, 928 and 938 of a magazine spring is shown above the contact lever of the switch 904, 914, 924 and 934 respectively. Showing the portion of the magazine spring and the contact lever of the switch in this manner depicts how the portion of the magazine spring moving in an upward direction 942, 944, 946 and 948 acts to close the switch 904, 914, 924 and 934, completing the circuit and causing electrical power to be delivered to the LED 906, 916, 926 or 936 respectively, to indicate a low ammunition condition. Depiction of the relative positioning and motion of the switch and the portion of the magazine spring in these schematics is for purposes of showing the operation of the circuit, and does not directly depict physical placement of circuit components in an embodiment. As various types of switches may be used in an embodiment, various symbols representing switches may be used in schematic diagrams of embodiments.

Figure 9E:
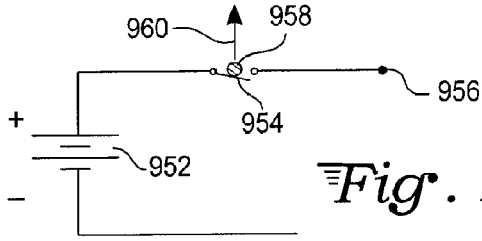
FIG. 9E is a circuit diagram of a sixth embodiment of the low ammunition indicator device from FIG. 9A, having an indicating terminal.

In FIG. 9E, a battery 952 and a switch 954 are shown in series connection. An indicating terminal 956 is connected to the output of the switch 954. A portion 958 of the magazine spring is shown in profile interacting to open or close the switch 954, in a manner similar to FIGS. 9A-9D. The indicating terminal 956 is available for connection to an indicating device or other component or circuitry (not shown), and indicates a low ammunition condition by making the output of the switch 954 available as a signal, a voltage, or switched current or power source. A change in state of the switch 954 activates and deactivates the indicating terminal 956. The circuit of FIG. 9E may be modified similarly to the circuits of FIGS. 9B-9D or other variations in further embodiments, such as by using various types of switches or adding a current-limiting resistor or an on/off switch.

Figure 10:
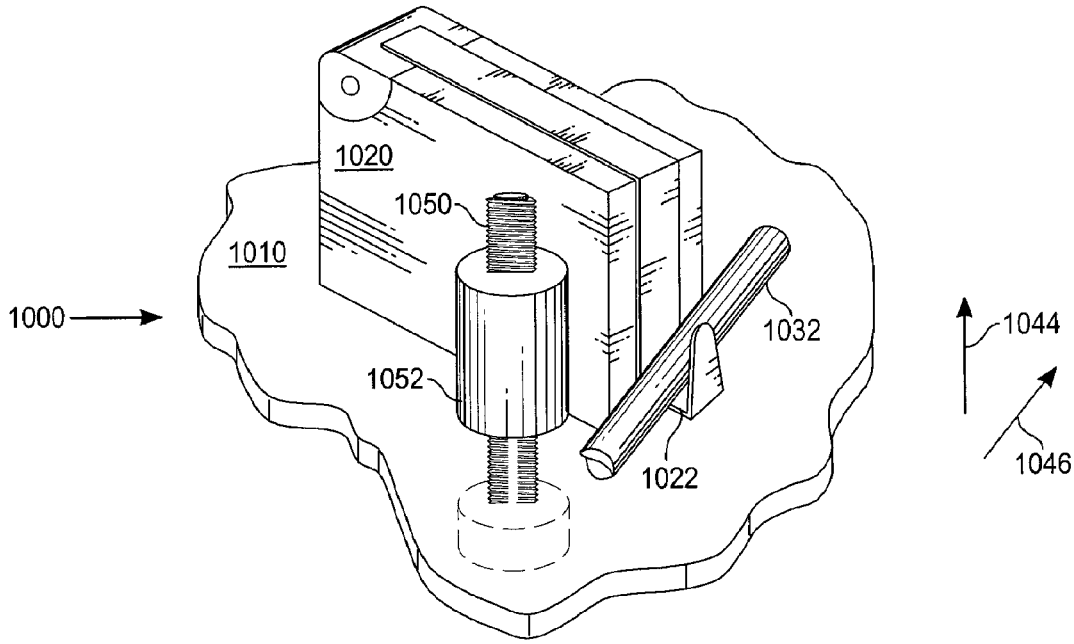
FIG. 10 is a perspective cutaway view of an adjustment mechanism applicable to the embodiment of FIGS. 1 and 2.

In FIG. 10, an adjustment mechanism 1000 is shown movably securing the switch 1020 to the plate 1010. Other components of a low ammunition indicator device have been removed for clarity, and plate 1010 is shown in cutaway view. The adjustment mechanism 1000 adjustably locates the switch 1020 relative to the portion 1032 of the magazine spring. A threaded nut 1052 is secured to the switch 1020 by means readily devised such as glue, molding or a bracket, or the switch body could be drilled and tapped for threading. A threaded bolt 1050 or other fastener engages the threads of threaded nut 1052, moving the threaded nut 1052 and attached switch 1020 as the threaded bolt 1050 is turned for adjustment purposes. The head of the bolt 1050 is shown in phantom view below the plate 1010, and may be turned with a suitable tool such as a screwdriver, nut driver or hex wrench fitting the bolt head. A tall nut such as a threaded collar may be used for the nut 1052, or the threaded bolt 1050 may directly engage a threaded switch body, in order to provide lateral rigidity to the adjustment mechanism. Shims, washers or a small spring (not shown) may be placed between the nut 1052 and the plate 1010 in order to take up slack in the adjustment mechanism. Other means of stabilizing the various parts may be applied.

Although the adjustment mechanism 1000 is shown adjusting a lever switch as the switch 1020, other switches may be used. Other adjustment mechanisms may be devised for moving a switch vertically such as in an upward direction 1044 or laterally such as in a horizontal direction 1046 or otherwise moving the switch with respect to the segment or portion 1032 of the magazine spring. Moving the switch 1020 tunes the response of the switch to the segment of the magazine spring by adjusting the spacing of the switch to the segment, the trip point of the switch relative to the spring or other factors. Adjusting the position of the switch relative to the segment 1032 of the magazine spring affects the predetermined number of remaining rounds to which the switch responds. For example, moving the switch 1020 in an upward direction 1044 decreases the predetermined number of remaining rounds for a low ammunition condition, since the portion 1032 of the magazine spring must move higher before tripping the switch 1020. Moving the switch 1020 in a downward direction (not shown, opposing the upward direction 1044) increases the predetermined number of remaining rounds for a low ammunition condition, since the portion 1032 of the magazine spring does not need to move as high before tripping the switch 1020. Using an adjustment mechanism may also allow for tuning the device as the magazine spring ages and the spring constant changes.

Embodiments of a device for indicating low ammunition in a firearm magazine provide a potentially life-saving addition to a standard firearm magazine. The firearm magazine operates unhindered by the addition of the low ammunition indicator device, which has a low parts count for reliability and low manufacturing cost. Embodiments may be available as a part or parts to be swapped for an existing part or parts of a magazine, as a kit to be retrofitted to magazine or as an entire, assembled magazine with the device included. Sealants, encapsulation, a cover or other protective or ruggedized packaging details may be devised.

What is claimed is:

1. A device for indicating when a firearm magazine has a limited amount of remaining ammunition, the device comprising:

a switch within a magazine for a firearm, mounted to a plate at a bottom end of the magazine and cooperating with a segment of a magazine spring; and an indicating terminal coupled with the switch such that a change in a state of the switch activates and deactivates the indicating terminal;

wherein "on" and "off" states of the switch correspond to differing positions of the segment of the spring relative to the switch and attendant differing amounts of ammunition in the magazine without reliance on having a follower contact the switch.

2. The device of claim 1 wherein the switch includes one of:

a lever switch;
a button switch;
a snap switch;
a contact switch;
an actuator switch;
a membrane switch;
a sealed switch;
a reed switch; or
a magnetic proximity sensor.

3. The device of claim 1 wherein the switch cooperating with a segment of a magazine spring includes the spring at least partially engaging an actuator associated with the switch.

4. The device of claim 1 wherein the switch cooperating with a segment of a magazine spring includes a reed switch responsive to a magnet attached to the segment of the magazine spring.

5. The device of claim 1 further comprising an indicating device electrically connected to the indicating terminal.

6. The device of claim 5 wherein the indicating device is a light visible external to the magazine.

7. The device of claim 1 wherein the plate is one of:

an insert;
a floor plate;
a base plate; or
a base pad.

8. A device for indicating low ammunition in a firearm magazine, comprising:

a switch internal to a firearm magazine, attached to a member selected from a group consisting of a magazine insert and a floor plate, and situated so as to be responsive to a portion of a magazine spring; and an indicating device in electrical connection with the switch;

wherein a position of the portion of the spring varies in response to a varied remaining amount of rounds in the magazine due to compression and extension of the spring; and wherein the switch directs activation of the indicating device in response to a range of positions of the portion of the spring corresponding to the remaining amount of rounds being less than or equal to a predetermined low ammunition count thereby detecting and indicating low ammunition without a requirement that a follower physically contacts the switch.

9. The device of claim 8 wherein the indicating device:

includes an incandescent bulb or an LED; and is located to illuminate in a rearward direction of the magazine.

10. The device of claim 8 further comprising a resistor configured to limit current through the indicating device.

11. The device of claim 8 wherein the switch is a first switch and further comprising a second switch for connecting and disconnecting electrical power to the first switch and the indicating device.

12. The device of claim 8 further comprising an adjustment mechanism movably securing the switch to the insert plate and adjustably locating the switch relative to the portion of the spring.

13. A firearm magazine, comprising:

a magazine case, a plate, a magazine spring and a follower;

a switch secured to the plate and responsive to a portion of the magazine spring and to a spacing from the portion of the spring to the plate;

a light secured to the plate, responsive to the switch and visible external to the magazine; and a battery contact secured to the plate for selectably powering the light;

wherein the switch directs available power from the battery contact to illuminate the light for the spacing from the portion of the spring to the plate being greater than or equal to a specified trip point distance, thereby detecting and indicating a low ammunition condition.

14. The firearm magazine of claim 13 wherein the plate is an insert, a floor plate, a base plate or a base pad.

15. The firearm magazine of claim 13 wherein the switch includes a normally closed switch having a topmounted lever at least partially engaging the spring.

16. The firearm magazine of claim 13 wherein the switch includes a normally closed switch having a sidemounted lever at least partially engaging the spring.

17. The firearm magazine of claim 13 wherein the switch includes a normally closed switch having a button at least partially engaging the spring.

18. The firearm magazine of claim 13 wherein the switch includes a reed switch responding to a magnet attached to the portion of the spring.

19. The firearm magazine of claim 13 wherein the battery contact is electrically operable to obtain the available power from one of:

a battery holder;

a replaceable battery; or a rechargeable battery.

20. The firearm magazine of claim 13 wherein the light is an incandescent bulb or an LED and is arranged to be visible to a user holding a firearm with the magazine inserted therein.

* * * * *